United States Patent [19]

Shaw

[11] 4,207,098

[45] Jun. 10, 1980

[54] NICKEL-BASE SUPERALLOYS

[75] Inventor: Stuart W. Shaw, Sutton Coldfield, England

[73] Assignee: The International Nickel Co., Inc., New York, N.Y.

[21] Appl. No.: 867,753

[22] Filed: Jan. 9, 1978

[51] Int. Cl.[2] ..... C22C 19/05

[52] U.S. Cl. ..... 75/171; 148/32.5

[58] Field of Search ..... 75/171; 148/32.5

[56] References Cited

U.S. PATENT DOCUMENTS

| | | | |
|---|---|---|---|
| 3,146,136 | 8/1964 | Bird et al. | 148/162 |
| 3,155,501 | 11/1964 | Kaufman et al. | 75/171 |
| 3,459,545 | 8/1969 | Bieber et al. | 75/171 |
| 3,486,887 | 12/1969 | Yoda et al. | 74/171 |
| 3,649,378 | 3/1972 | Kotval | 148/127 |
| 3,677,747 | 7/1972 | Lund et al. | 75/171 |
| 3,865,581 | 2/1975 | Sekino et al. | 75/122 |
| 3,918,964 | 11/1975 | Baldwin et al. | 75/171 |
| 4,082,581 | 4/1978 | Ghosh | 148/32 |

FOREIGN PATENT DOCUMENTS

| | | |
|---|---|---|
| 813948 | 5/1959 | United Kingdom . |
| 863912 | 3/1961 | United Kingdom . |
| 1302160 | 1/1973 | United Kingdom . |
| 1395125 | 5/1975 | United Kingdom . |
| 1452660 | 10/1976 | United Kingdom . |

OTHER PUBLICATIONS

Khimiushin, "High Temp. Steels & Alloys", FTD-H-C-23-391-70, Part I, pp. 398-400.

*Primary Examiner*—Arthur J. Steiner
*Assistant Examiner*—Upendra Roy
*Attorney, Agent, or Firm*—E. C. MacQueen; F. J. Mulligan

[57] ABSTRACT

Nickel-base superalloys suitable for the production of cast parts for use at elevated temperatures in corrosive atmospheres contain in weight percent about 14% to 22% chromium, 5% to 25% cobalt, 1% to 5% tungsten, 0.5% to 3% tantalum, 2% to 5% titanium, 1% to 4.5% aluminum, the sum of the titanium plus aluminium being 4.5 to 9% up to 2% niobium, 0.31% to 1.2% boron, up to 3.5% molybdenum, up to 0.5% zirconium, up to 0.2% in total of yttrium or lanthanum or both, up to 0.1% carbon, the balance apart from impurities being nickel. Advantageously the alloys are controlled such that $$\%Ti + \%Al + \%Nb + 0.5(\%Ta) + 0.2(\%Cr) = 11.2 \text{ to } 12.4.$$

19 Claims, No Drawings

NICKEL-BASE SUPERALLOYS

This invention relates to nickel-base superalloys which are particularly suitable for the production of cast parts for use at elevated temperatures in corrosive atmospheres, such as, for example, in gas turbines.

STATE OF THE ART

The continual demand by gas turbine manufacturers for alloys with improved high temperature properties has lead to extensive development work. One proposal disclosed in U.K. Pat. No. 1,395,125 to improve the high temperature properties of a wide range of nickel-base superalloys was to control the carbon and boron contents such that the carbon content was maintained at a relatively low level whereas the boron content was between 0.05 and 0.3% which is considerably above that normally employed; preferably the boron content did not exceed 0.25%, the most preferred range being from 0.05 to 0.15%.

DISCOVERY

We have now surprisingly found that with certain nickel-base alloys in which the alloying constituents are carefully controlled and closely correlated with each other, improvements can be obtained with boron contents greater than 0.3% and up to as high as 1.2%.

OBJECTS

It is an object of the present invention to provide improved alloys and castings.

Other objects and advantages will become apparent from the following description.

DESCRIPTION

Accordingly the present invention provides an alloy containing, by weight, from 14 to 22% chromium, from 5 to 25% cobalt, from 1 to 5% tungsten, from 0.5 to 3% tantalum, from 2 to 5% titanium, from 1 to 4.5% aluminum, the sum of the titanium plus aluminum being from 4.5 to 8.5 or 9%, from 0 to 2% niobium, 0.31 to 1.2% boron, from 0 to 3.5% molybdenum, from 0 to 0.5% zirconium, from 0 to 0.2% in total of yttrium or lanthanum or both, and from 0 to 0.1% carbon, the balance, apart from impurities, being nickel.

The alloys must contain at least 14% chromium for good corrosion resistance but no more than 22% chromium in order to minimize the risk of detrimental sigma phase formation during extensive high temperature service. Preferably the chromium content is from 15 to 21%, for example from 15 to 17% or from 19 to 21%. The presence in the alloys of from 5 to 25% cobalt has a strengthening effect but more than 25% cobalt could lead to sigma phase formation. Preferably the cobalt content is from 5 to 22%, for example 7 to 20%.

The presence of tantalum, titanium, aluminum and niobium also has a strengthening effect on the alloys. At least 0.5% tantalum must be present, preferably 0.8 to 2.5%, for example 1.0 to 2.0% but more than 3% leads to embrittlement. Niobium can be optionally present in an amount up to 2% and preferably is present in an amount of at least 0.2 or 0.5%. However more than 2% can cause embrittlement and the niobium content preferably does not exceed 1.5%.

The titanium and aluminum contents must be in the ranges 2 to 5% and 1 to 4.5%, respectively with the sum of the titanium plus aluminium being from 4.5 to 8.5 or 9.0%. More than the maximum of either of these elements leads to embrittlement and preferred titanium contents are from 2.5 to 4.5%, for example 3 to 4%, with preferred aluminum contents being from 1.5 to 4%, for example 1.8 to 3.8%.

For optimum stress rupture properties the titanium, aluminum, noibium, tantalum and chromium contents are preferably correlated such that:

$$\%Ti+\%Al+\%Nb+0.5(\%Ta)+0.2(\%Cr)=11.2 \text{ to } 12.4$$

The boron content is critical for achieving the alloys' excellent properties and must be present in amounts at least 0.31%, e.g., at least 0.35% but not exceeding 1.2%. Contents outside this range lead to a reduction in stress rupture life properties. Preferably the boron content is at least 0.4% preferably from 0.4 to 1%, for example 0.5 to 1%. Coupled with this boron content, the carbon should be kept as low as possible and must not exceed 0.1%, preferably not more than 0.05% and most advantageously not more than 0.03%, as this also leads to a reduction in stress rupture life properties.

Tungsten and molybdenum, when present, contribute to strength. Tungsten must be present in an amount of from 1 to 5%, preferably from 1.5 to 4%, for example 1.8 to 3%, and molybdenum must not be present in amounts greater than 3.5%. Preferably the molybdenum content is at least 0.2% but no more than 2%. Zirconium improves strength and ductility of the alloy and can optionally be present in an amount not exceeding 0.5%. A suitable zirconium range is from 0.01 to 0.3%, preferably 0.02 to 0.2%.

Yttrium or lanthanum or both may be present up to 0.2% in total for improved ductility. However, more than 0.2% leads to inadequate ductility.

Overall, for optimum properties it is preferred that the boron content is more than 0.6% and a preferred alloy contains either from 15 to 17% chromium with 7 to 10% cobalt, or from 19 to 21% chromium with 13 to 17% cobalt, from 2.1 to 2.8% tungsten, from 1.4 to 2.0% tantalum, from 3.2 to 4.0% titanium, from 2.2 to 3.8% aluminum, from 0.5 to 1.5% niobium, from 0.6 to 1.0% boron, from 0.2 to 2.0% molybdenum, from 0.03 to 0.08% zirconium, from 0 to 0.2% in total of yttrium or lanthanum or both, and from 0 to 0.03% carbon, balance nickel.

In addition, in most preferred alloys the titanium, aluminum, niobium, tantalum and chromium correlation stated above should be applied.

Of the elements that may be present as impurities, silicon has a deleterious effect on corrosion resistance and should be kept below 1% and preferably below 0.5%. Other impurities may include up to 1% manganese and up to 3% iron together with additional elements which are commonly associated with alloys of this type and which do not have a detrimental affect on their properties.

To develop the full stress rupture properties of the alloys of the invention, they should be subjected to a heat treatment comprising solution-heating and subsequent ageing. The solution treatment advantageously comprises heating for from 1 to 12 hours at a temperature in the range of from 1100° to 1180° C. and the alloys may then be aged by heating for from 8 to 48 hours at a temperature in the range of from 800° to 900° C. The single final ageing treatment may advantageously be replaced by a two stage ageing treatment comprising heating for from 4 to 24 hours at a temperature in the range of from 900° to 1000° C. followed by heating for from 8 to 48 hours at a temperature in the range of from 700° to 800° C. Cooling after each heat treatment stage may be carried out at any convenient rate, and air cooling is generally suitable.

In the heat treated state alloys according to the invention have minimum stress rupture lives which to some extent decrease with increasing chromium content. Thus for a chromium content of 15 to 17% the alloys would have a stress rupture life of at least 260 hours at 550 N/mm$^2$ and 760° C. and for a chromium content of 19 to 21% would have a stress rupture life of at least 200 hours at 550 N/mm$^2$ and 760° C. However, it should be noted that a surprising feature of the invention is that with the most preferred alloys the best results appear to be obtained with the higher chromium contents.

The fact that the alloys of this invention possess an excellent combination of properties including stress rupture properties coupled with corrosion resistance in particular is illustrated by the following examples.

EXAMPLES

A number of alloys with compositions shown in Table I were vacuum melted and cast in vacuum to tapered test bar blanks from which test pieces were machined. Prior to the machining of the test pieces, the blanks were heat treated by solution heating at 1121° C. for 2 hours, air cooling, and ageing at 843° C. for 24 hours, and air cooling in respect of Alloys A and 1 to 4, and by solution heating at 1160° C. for 4 hours, air cooling, and ageing at 850° C. for 16 hours and air cooling in respect of Alloys B, 5 and 6. The heat treated test pieces were then subjected to various stress rupture tests with the results shown in Table II. In Tables I and II Alloys 1 to 6 are according to the present invention and Alloys A and B are comparative alloys outside the scope of the present invention.

TABLE I

| | Composition wt % balance Ni | | | | | | | | | | |
|---|---|---|---|---|---|---|---|---|---|---|---|
| Alloy | Cr | C | Co | Mo | W | Nb | Ta | Ti | Al | Zr | B |
| A | 15.8 | 0.013 | 8.5 | 1.74 | 2.55 | 0.85 | 1.75 | 3.57 | 3.36 | 0.055 | 0.20 |
| 1 | 16.0 | 0.009 | 8.4 | 1.73 | 2.59 | 0.85 | 1.75 | 3.56 | 3.34 | 0.054 | 0.31 |
| 2 | 16.3 | 0.017 | 8.4 | 1.73 | 2.73 | 0.86 | 1.73 | 3.53 | 3.45 | 0.054 | 0.48 |
| 3 | 16.5 | 0.012 | 8.6 | 1.76 | 2.63 | 0.84 | 1.77 | 3.63 | 3.43 | 0.050 | 0.60* |
| 4 | 16.5 | 0.013 | 8.5 | 1.76 | 2.72 | 0.85 | 1.73 | 3.63 | 3.43 | 0.054 | 0.71 |
| B | 20.4 | 0.014 | 14.8 | 0.49 | 2.32 | 0.98 | 1.50 | 3.72 | 2.54 | 0.05 | 0.20 |
| 5 | 20.5 | 0.008 | 15.0 | 0.52 | 2.40 | 0.96 | 1.49 | 3.67 | 2.54 | 0.05 | 0.40 |
| 6 | 20 | 0.01 | 15.0 | 0.5 | 2.2 | 1.0 | 1.5 | 3.6 | 2.5 | 0.05 | 0.60 |

*Nominal

TABLE II

| | STRESS RUPTURE | | | | | |
|---|---|---|---|---|---|---|
| | 550 N/mm$^2$/760° C. | | 330 N/mm$^2$/816° C. | | 228 N/mm$^2$/927° C. | |
| | Life (hours) | Elong. (%) | Life (hours) | Elong. (%) | Life (hours) | Elong. (%) |
| A | 250 | 6.3 | 1001 | 5.0 | 62 | 13.3 |
| 1 | 267 | 5.9 | 1007 | 10.3 | 71 | 11.9 |
| 2 | 321 | 7.1 | 1067 | 8.7 | 62 | 13.8 |
| 3 | 363 | 5.8 | 1735 | 10.0 | 58 | 14.6 |

TABLE II-continued

| | STRESS RUPTURE | | | | | |
|---|---|---|---|---|---|---|
| | 550 N/mm$^2$/760° C. | | 330 N/mm$^2$/816° C. | | 228 N/mm$^2$/927° C. | |
| | Life (hours) | Elong. (%) | Life (hours) | Elong. (%) | Life (hours) | Elong. (%) |
| 4 | 454 | 4.8 | 1173 | 7.2 | 80 | 11.3 |
| B | 185 | 3.3 | | | 33 | 7.4 |
| 5 | 217 | 4.0 | >504 | N.A. | 39 | 14.8 |
| 6 | 658 | 2.6 | 910 | 2.5 | 61, 90* | 5.1, 5.4* |

N.A. = not available
* = two tests

It can be seen from a comparison of the results in Table II that the lower chromium content Alloys 1 to 4 had better stress rupture life and elongation properties over the entire range of test conditions employed than Alloy A. Similarly the higher chromium content Alloys 5 and 6 also had better stress rupture life and elongation properties, at the test conditions employed, than Alloy B.

Considering the lower chromium content Alloys 1 to 4 containing nominally 16% chromium, it can be seen from the results of Table II, that the stress rupture properties increase with increasing boron content at 550 N/mm$^2$/760° C., peak at about 0.60% boron at 330 N/mm$^2$/816° C. and are generally good over the whole boron range at 228 N/mm$^2$/927° C. The higher chromium content Alloys 5 and 6 containing nominally 20% chromium showed improving stress rupture properties with increasing boron content up to 0.80%. Thus for optimum stress rupture properties it is preferred that alloys according to the invention should contain between 0.4, preferably 0.5, and 1.0% boron.

Further tests were conducted to compare the properties of Alloy No. 7 (being a preferred alloy of the invention) with a known commercial alloy (Alloy C, available under the designation IN-792). The compositions of both Alloys are shown in Table III. Again test pieces were prepared by vacuum melting and casting in vacuum to produce tapered test bar blanks from which test pieces could be machined. The heat treatment used in these further tests, prior to machining was a simple two stage treatment comprising solution heating for four hours at 1150° C. and air cooling followed by ageing at 850° C. for 16 hours and air cooling.

TABLE III

| Alloy | Cr | C | Co | Mo | W | Nb | Ta | Ti | Al | Zr | B | Ni |
|---|---|---|---|---|---|---|---|---|---|---|---|---|
| 7 | 20.5 | 0.021 | 15.0 | 0.53 | 2.31 | 0.98 | 1.63 | 3.70 | 2.64 | 0.065 | 0.79 | Bal |
| 7 (modified) | 20.0 | 0.01 | 15.0 | 0.50 | 2.2 | 1.0 | 1.5 | 3.6 | 2.5 | 0.05 | 0.80 | Bal |
| C | 12.6 | 0.125 | 9.0 | 1.98 | 3.91 | — | 3.95 | 4.30 | 3.62 | 0.08 | 0.018 | Bal |

The heat treated test pieces were then subjected to various standard stress-rupture tests, the results of which as shown in Table IV.

TABLE IV

| Stress | Test | Alloy No. 7 | | Alloy C | |
|---|---|---|---|---|---|
| (N/mm²) | (°C.) | Life | Elong. | Life | Elong. |
| 620 | 760 | 498 | 2.7 | 161 | 5.2 |
| 550 | " | 1797 | 2.5 | 499 | 5.2 |
| 500 | " | >2089 | | 1668 | 2.6 |
| 545 | 816 | 133[x] | 2.5[x] | — | — |
| 414 | 816 | 581 | 3.1 | 543 | 6.0 |
| 400 | " | 873 | 5.2 | 917 | 4.4 |
| 345 | " | 2461 | 3.6 | 2085 | 3.7 |
| 330 | " | 3404[x] | 1.7[x] | — | — |
| 300 | " | >2785 | | >1439 | |
| 269 | 927 | 97 | 8.2 | 133 | 8.2 |
| 228 | " | 199 | 4.7 | | |
| 200 | " | 516 | 6.2 | 692 | 8.2 |
| 154 | " | >1336 | | >985 | |
| 152 | 980 | 185[x] | 6.8[x] | | |

[x]modified Alloy No. 7

It should be noted that two different heats of Alloy No. 7 were used in these tests and it is shown in Table IV which heat was employed for each particular test.

These latter test results demonstrate that in general Alloy No. 7 of the invention has a strength which is at least equivalent to and, in some cases, significantly superior to that of Alloy C (IN-792), particularly at lower temperatures, for example 760° C., which has hitherto always been considered to be an extremely strong alloy. In addition, the ductility of Alloy No. 7 (based on a comparison of the elongation figures) is in general equivalent to that of Alloy C with the exception of that at 760° C. where the strength of Alloy No. 7 is superior.

Comparison of these stress rupture test properties of Alloy No. 7 with published data of another commercially available alloy sold under the designation IN-100 also shows the superiority of Alloy No. 7 at 760° C. and at least equality at 816° C., and 980° C.

In addition to the high strength of the alloys of the invention, they are also characterized by high corrosion resistance. This fact is demonstrated by crucible tests in which standard size cylindrical samples of Alloy No. 7 were immersed in a 25% sodium chloride, 75% sodium sulphate solution.

In a first test of 900° C. for 300 hours with the salts being replenished after 150 hours, the weight loss of the sample after descaling was found to be as low as 2 mg/cm². In a more agressive test at the same temperature in which the salt was replenished every 24 hours, the weight loss was also very low at 16 mg/cm².

By comparison, a similar sample of comparative Alloy C (IN-792) was found to have corroded extremely badly after only 48 hours in a test at 850° C., with a weight loss of 562 mg/cm².

The alloys of the invention may be used in cast or wrought form for high temperature uses such as for gas turbine engine parts, for example rotor or stator blades and integrally bladed discs.

The heat treatments described above to develop the properties of the alloys may be supplemented by other more complex treatments which are known to be appropriate to alloys of this type. In addition to normal casting techniques, other techniques such as unidirectional solidification may be employed if desired.

While the present invention has been described with reference to the foregoing embodiments, these embodiments are not to be taken as limiting since persons skilled in the art will appreciate that modifications and variations can be resorted to without departing from the spirit and scope of the invention.

I claim:

1. An alloy consisting essentially of, by weight, 14% to 22% chromium, 5% to 25% cobalt, 1% to 5% tungsten, 0.5% to 3% tantalum, 2% to 5% titanium, 1% to 4.5% aluminum, with the sume of the titanium plus aluminum being 4.5% to 9.0%, 0 to 2% niobium, 0.31 to 1.2% boron, 0 to 3.5% molybdenum, 0 to 0.5% zirconium, 0 to 0.2% in total of yttrium of lanthanum or both, and 0 to 0.1% carbon, the balance apart from impurities, being essentially nickel.

2. An alloy as in claim 1 in which the boron content is at least 0.4%.

3. An alloy as in claim 1 in which the boron content does not exceed 1%.

4. An alloy as in claim 2 in which the boron content is at least 0.5%.

5. An alloy as in claim 1 in which the carbon content does not exceed 0.05%.

6. An alloy as in claim 1 in which the chromium content is 15% to 21%.

7. An alloy as in claim 6 in which the chromium content does not exceed 17%.

8. An alloy as in claim 6 in which the chromium content is at least 19%.

9. An alloy as in claim 1 in which the cobalt content is 5% to 22%.

10. An alloy as in claim 1 in which the tantalum content is from 0.8% to 2.5%.

11. An alloy according to claim 1 in which the alloy contains at least 0.5% niobium.

12. An alloy according to claim 1 in which the titanium content is 2.5% to 4.5%.

13. An alloy according to claim 1 in which the aluminum content is 1.5% to 4%.

14. An alloy according to claim 1 in which the titanium, aluminum, niobium, tantalum and chromium contents are correlated such that:

$$\%Ti+\%Al+\%Nb+0.5(\%Ta)+0.2(\%Cr)=11.2 \text{ to } 12.4.$$

15. An alloy according to claim 1 in which the tungsten content is 1.5% to 4%.

16. An alloy according to claim 1 in which molybdenum is present in an amount of 0.2% to 2%.

17. An alloy according to any preceding claim in which zirconium is present in an amount of 0.01% to 0.3%.

18. An alloy according to claim 1 containing 15% to 17% chromium, 7% to 10% cobalt, 2.1% to 2.8% tungsten, 1.4% to 2.0% tantalum, 3.2% to 4.0% titanium, 2.2% to 3.8% aluminum, 0.5% to 1.5% niobium, 0.6% to 1.0% boron, 0.2% to 2.0% molybdenum, 0.03% to 0.08% zirconium, 0% to 0.2% in total of yttrium or lanthanum or both, and 0% to 0.03% carbon.

19. An alloy according to claim 1 containing 19% to 21% chromium, 13% to 17% cobalt, 2.1% to 2.8% tungsten, 1.4% to 2.0% tantalum, 3.2% to 4.0% titanium, 2.2% to 3.8% aluminum, 0.5% to 1.5% niobium, 0.6% to 1.0% boron, 0.2% to 2.0% molybdenum, 0.03% to 0.08% zirconium, 0% to 0.2% in total of yttrium or lanthanum or both, and 0% to 0.03% carbon.

* * * * *